US005905239A

United States Patent [19]

Turner et al.

[11] Patent Number: 5,905,239

[45] Date of Patent: May 18, 1999

[54] MOTOR OPERATOR WITH BURN-OUT PROTECTION

[75] Inventors: David Curtis Turner, North Fayette; Craig Joseph Puhalla, Moon Township, both of Pa.

[73] Assignee: Eaton Corporation, Cleveland, Ohio

[21] Appl. No.: 08/985,469

[22] Filed: Dec. 5, 1997

Related U.S. Application Data

[63] Continuation-in-part of application No. 08/699,305, Aug. 19, 1996, Pat. No. 5,695,046.

[51] Int. Cl.[6] ..... H01H 3/20

[52] U.S. Cl. ..... 200/330; 200/332.1

[58] Field of Search ..... 200/330, 321.1, 200/400, 401, 329, 332.2, 332.1

[56] References Cited

U.S. PATENT DOCUMENTS 550,429 4/1895 Baginski et al. ..... 200/330

5,196,658 3/1993 Gula ..... 200/50 R 5,354,960 10/1994 Erickson ..... 200/400

5,475,190 12/1995 Smith et al. ..... 200/330

*Primary Examiner*—David J. Walczak

*Attorney, Agent, or Firm*—Martin J. Moran

[57] ABSTRACT

A motor operator for a circuit breaker has a motor driven carriage which engages a circuit breaker handle and drives it between an on position and a reset position beyond off. When the carriage drives the handle to the on position, an on limit switch is actuated to deenergize the motor. A fastener releasably secures a bracket slidably mounted on the carriage to a fixed member when the carriage reaches the on position of the handle so that if the circuit breaker is not reset and rebounds toward a trip position, the bracket is extended and maintains actuation of the on limit switch. Hence, the motor is not repeatedly energized and burned out in unsuccessful attempts to turn on the circuit breaker. A similar arrangement prevents the motor from cycling when the off relay is latched.

9 Claims, 10 Drawing Sheets

MOTOR OPERATOR WITH BURN-OUT PROTECTION

CROSS-REFERENCE TO RELATED APPLICATIONS

This application is a continuation-in-part of application Ser. No. 08/699,305 filed Aug. 19, 1996, now U.S. Pat. No. 5,695,046, having a common inventive entity and assigned to the assignee of this Application.

BACKGROUND OF THE INVENTION

1. Field of the Invention

This invention relates to motor operators for electrically positioning the handle of an electrical switch such as a circuit breaker. More particularly, it relates to such a motor operator with a device which prevents repeated unsuccessful attempts to turn on a circuit breaker that has not been reset.

2. Background Information

Electrical switches, such as circuit breakers, typically have a handle by which the contacts of the circuit breaker can be manually opened and closed. They can also be automatically opened, or tripped, in response to currents which exceed defined amplitude/time-characteristics. In many such circuit breakers, the handle must be moved beyond the off position to a reset position following a trip before the handle can be returned to the on position. Often, the handle is spring biased to a position between off and on when the circuit breaker is tripped to provide a visual indication of the tripped condition.

In many applications, a motor operator is provided to position the circuit breaker handle. The motor operator makes it easier to operate large circuit breakers and also provides the capability for remote operation of the circuit breaker. An example of a common type of motor operator is described in U.S. Pat. No. 5,196,658. Such motor operators have a carriage which engages the handle of the circuit breaker. The carriage is reciprocally driven to move the handle to the on and off/reset positions by a threaded shaft which is rotated by an electric motor in response to the operator's activation of a latched relay which energizes the motor. The power circuit for the electric motor includes on and off limit switches which are actuated when the carriage has driven the handle to the on and off/reset positions respectively to terminate energization of the motor. In certain cases, the motor does not have sufficient torque to reset the circuit breaker when starting from the tripped position. In these cases, the handle should be first moved to the on position so that the motor operator generates sufficient inertia to reset the circuit breaker. If the circuit breaker is not reset, the springs biasing the handle to the intermediate tripped position cause the carriage to rebound from the off/reset position toward the trip position by a distance which results in deactuation of the off limit switch. This results in reenergization of the motor with a polarity which again drives the carriage toward the off/reset position. Again, this results in reactuation of the off limit switch to deenergize the motor, but since the motor lacks sufficient torque to reset the circuit breaker, the carriage again rebounds deactuating the off limit switch. Thus, the motor repetitively tries to reset the breaker eventually causing burn-out of the motor. patent application Ser. No. 08/699,305 cited above, addresses this problem and provides an override which maintains the off limit switch in an activated condition if the carriage rebounds from the off/reset position toward the trip position.

A related problem has been identified where a circuit breaker fails to reset and the motor operator is activated to turn on the circuit breaker. If the circuit breaker is not reset, the springs biasing the handle to the intermediate tripped position cause the carriage to rebound from the on position toward the trip position by a distance which results in deactivation of the on limit switch. This results in reenergization of the motor with a polarity which again drives the carriage towards the on position. This can repeatedly occur, and thus can similarly result in burn-out of the motor.

There is a need therefore for an improved motor operator for operating the handle of electrical switches such as circuit breakers.

More particularly, there is a need for such an improved motor operator which does not permit cycling of the motor operator in either direction if the circuit breaker does not reset.

SUMMARY OF THE INVENTION

These needs and others are satisfied by the invention which is directed to a motor operator for a circuit breaker having a handle moveable from an on position, through a trip position to an off position and a reset position for resetting the circuit breaker following a trip. The handle is spring biased toward the trip position from the on and off positions until the circuit breaker is reset following a trip. The motor operator includes a carriage engaging the circuit breaker handle and mounted for reciprocal movement along a longitudinal axis for operating the handle between the on and reset positions. An electric motor reciprocally drives the carriage when energized. The electric motor is energized by a power circuit including an off limit switch which is actuated by the carriage with the handle in the off/reset position, and an on limit switch which is actuated by the carriage with the handle in the on position, to deenergize the electric motor when the circuit breaker is respectively reset, or turned on. However, these switches are normally unactuated when the handle and therefore the carriage rebound toward the trip position when the circuit breaker does not reset. In accordance with the invention, override means maintains actuation of the off limit switch or on limit switch, as the case may be, when the handle, and therefore the carriage, rebound toward the trip position following an unsuccessful attempt to reset or turn on the circuit breaker.

The override means comprises separate mechanisms respectively corresponding to the on and off limit switches. In one embodiment, each override mechanism comprises first means secured to the housing and second means secured to the carriage which releasably engage to maintain the off or on limit switches actuated as the case may be when the circuit breaker does not reset or as a result thereof does not engage in the on position. One of these first and second means comprises a first member of a releasable fastener and the other of the first and second means comprises a bracket, means slidably mounting the bracket for movement parallel to the longitudinal axis of movement of the carriage, and a second member of the releasable fastener provided on the bracket. The first and second members of the releasable fastener engage as the carriage travels toward the reset position or on position and remain engaged as the carriage rebounds when the circuit breaker is not reset. Under these conditions, the bracket slidably extends to retain engagement and maintain the off or on limit switch actuated so that the motor can not be reenergized upon rebound of the carriage. The first and second members of the releasable fastener disengage when the carriage is driven toward the opposite position by the electric motor, thereby deactuating the corresponding limit switch for the next cycle. Preferably, the one of the first and second means is the first means and the other is the second means so that the bracket is slidably mounted on the carriage. Biasing means such as a spring bias the bracket toward the carriage so that when the releasable fastener disengages, the bracket is retracted against the carriage. The invention can be employed to control deactivation of both limit switches or just the on limit switch. In still another embodiment, the override mechanism carriage bracket interfacing with the on limit switch is fixedly mounted to the carriage to maintain the carriage in the on position when engaged. This latter arrangement enables the carriage to achieve maximum momentum when driven to the off position to reset the breaker.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
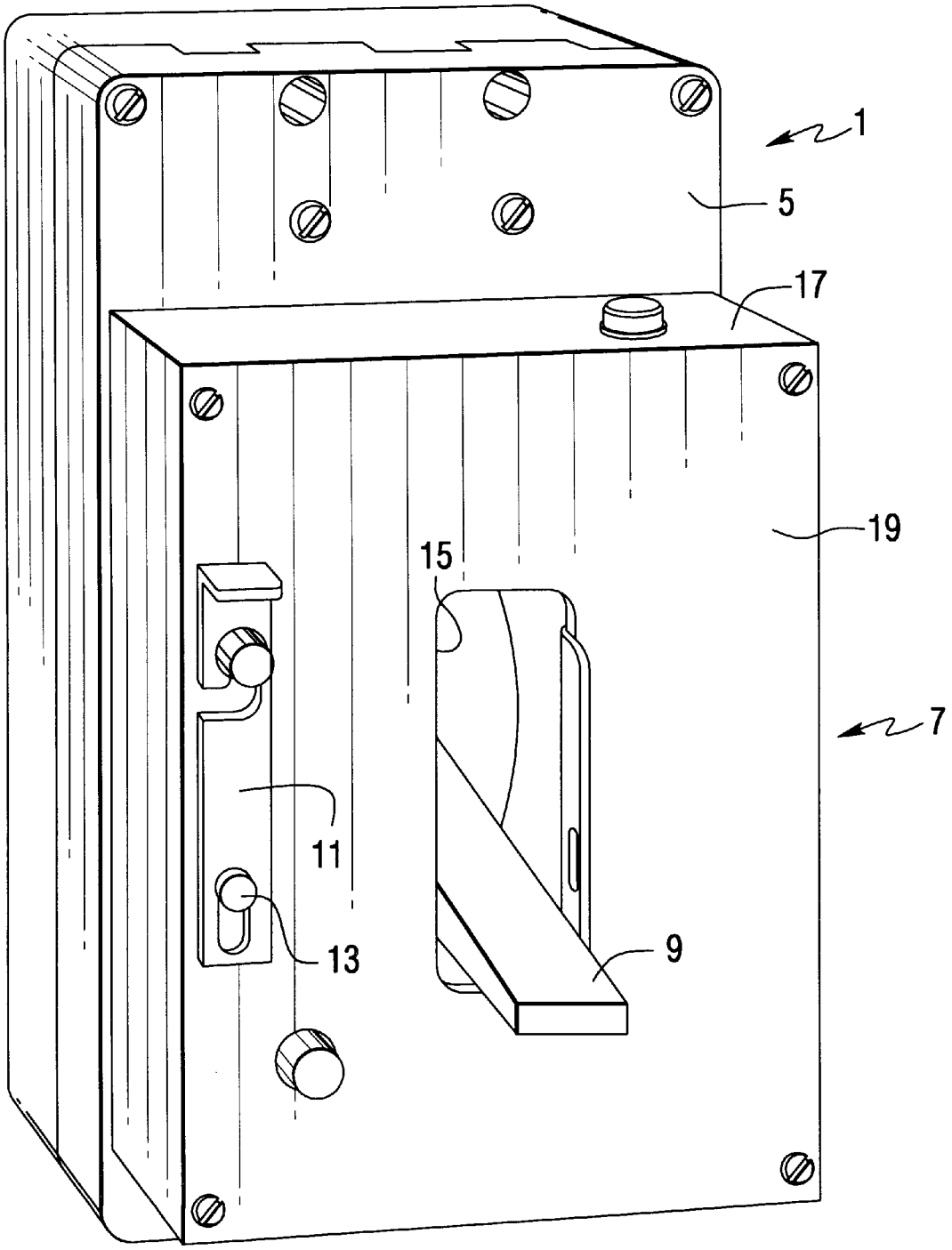
FIG. 1 is an isometric view of a circuit breaker with a motor operator incorporating the invention.
Figure 2:
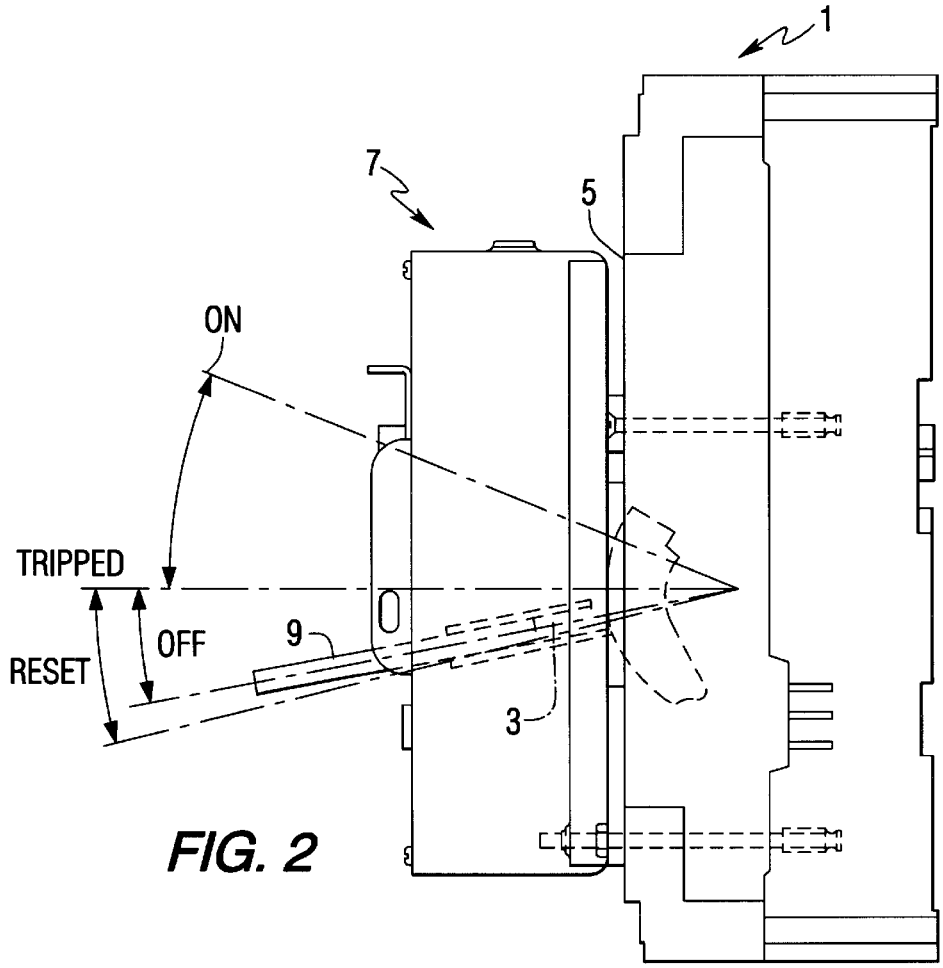
FIG. 2 is a side elevation view of the circuit breaker and motor operator of FIG. 1 illustrating operation of the circuit breaker handle.

FIGS. 1 and 2 illustrate a circuit breaker I such as a well known low voltage molded case circuit breaker. The circuit breaker 1 has a handle 3 projecting from a front face 5. The handle 3 moves in an arcuate path between an on position in which power contacts (not shown) within the circuit breaker are closed and an off position in which the power contacts are open. As is well known, the circuit breaker also includes a trip mechanism (not shown) which responds to certain currents/time characteristics of load current passing through the circuit breaker to automatically trip the power contacts open. When this occurs, the handle 3 assumes a tripped position which is intermediate the off and on positions. In order to reset the circuit breaker so that it can be returned to the on position, the handle must be moved beyond the off position to a reset position which mechanically resets the trip mechanism. If the trip mechanism resets, the handle returns to the off position when released. On the other hand, if the trip mechanism does not reset, when the handle is released, it will return to the tripped position.

While the handle of the circuit breaker is normally operated manually, a motor operator 7 provides the capability for remote operation. The motor operator 7 is bolted to the front face of the circuit breaker 1 over the handle 3. The handle is provided with an extension 9 which protrudes through the front face of the motor operator so that the circuit breaker can still be alternatively manually operated. A mechanical interlock 11 pivotally mounted to the motor operator by pin 13, can be raised up from the stored position shown in FIG. 1 and rotated clockwise to extend across the handle slot 15 in the motor operator to lock the circuit breaker in the off position as is well known.

Figure 3:
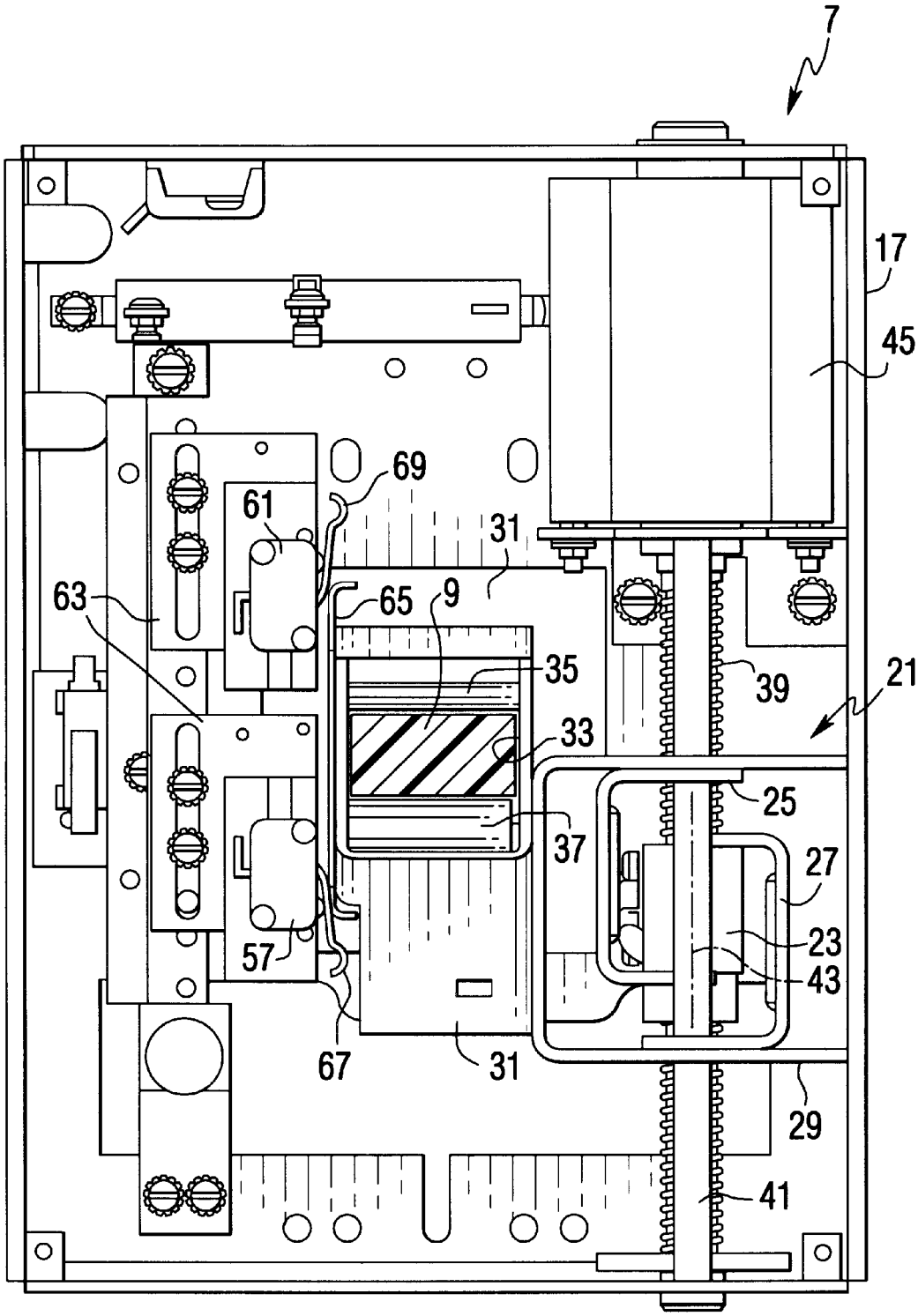
FIG. 3 PRIOR ART
FIG. 3 is a plan view of a motor operator without the benefit of the invention shown with the cover removed and with the handle in the tripped position with the end portion removed for clarity.
Figure 5:
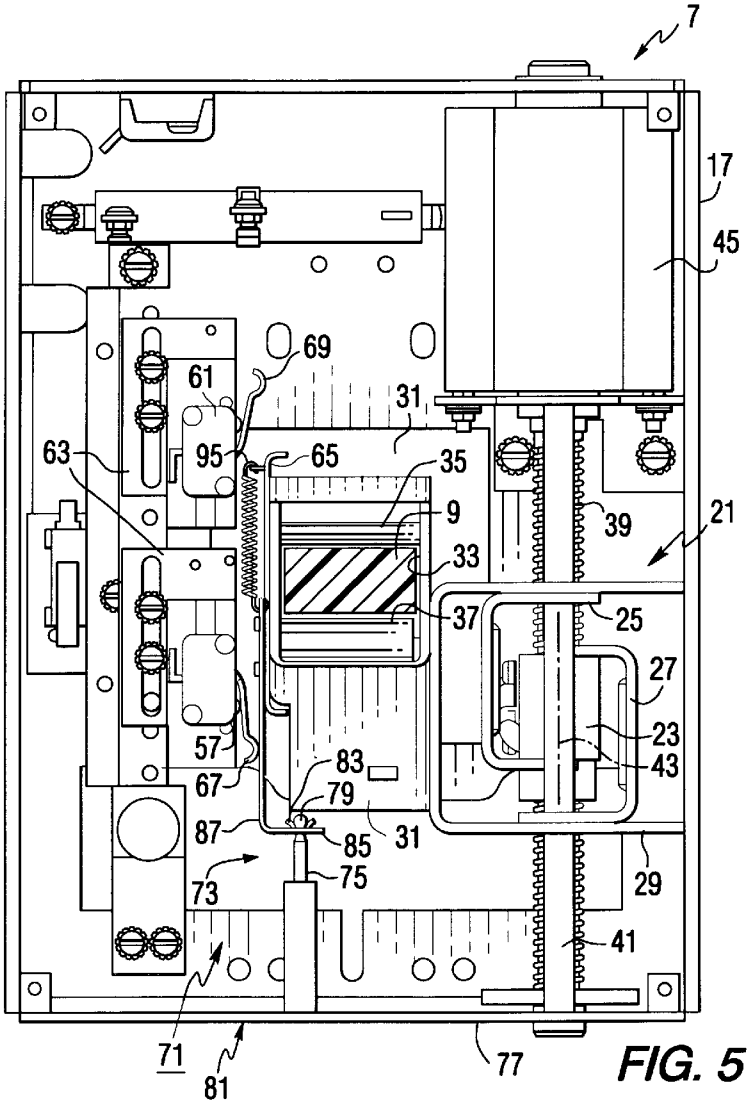
FIG. 5 is a plan view similar to that of FIG. 4 showing the handle in the trip position.
Figure 4:
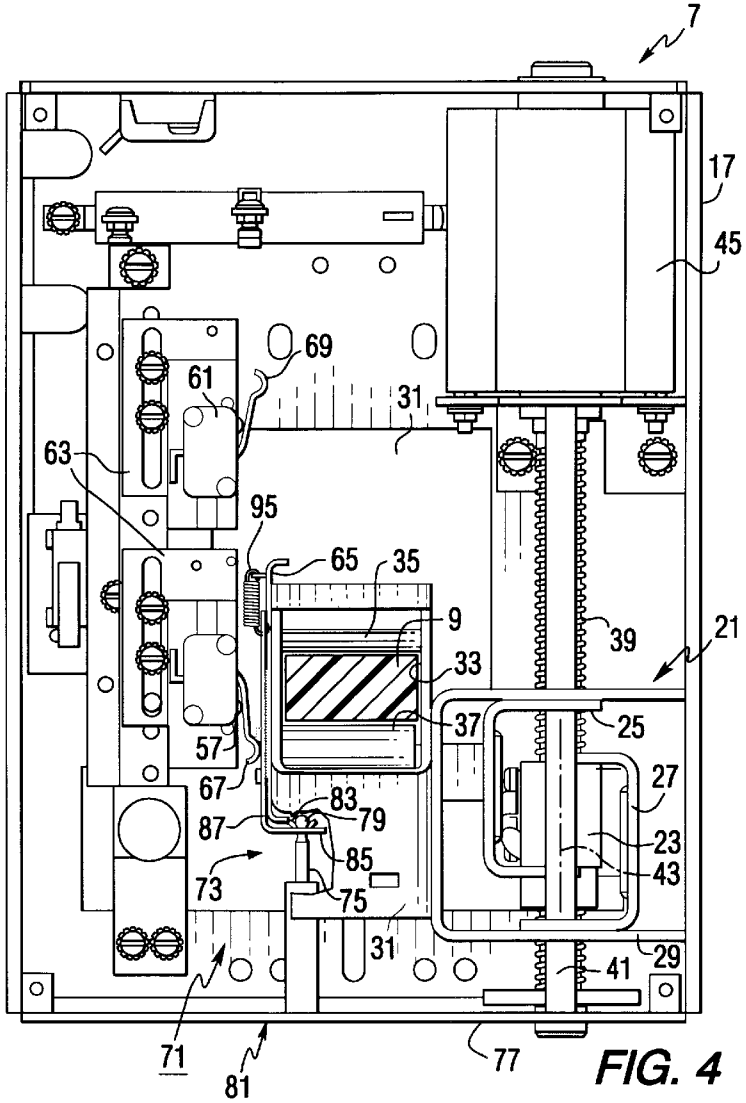
FIG. 4 illustrates a plan view with the cover removed of the motor operator incorporating the invention, again with the end portion removed for clarity, showing the handle in the on position.

As shown in FIGS. 3–5, the motor operator 7 includes an enclosure 17 shown with the lid 19 (see FIG. 1) removed. Within the enclosure 17 is a carriage assembly 21 which includes a ball nut 23 supported by two U-shaped brackets 25 and 27 mounted within a larger U-shaped bracket 29. The carriage assembly 21 further includes a plate 31 extending laterally from the U-shaped bracket 29 and having an opening 33 through which the handle extension 9 (not shown in FIG. 3) extends. Supported on the carriage assembly 21 adjacent the opening 33 are a pair of spaced apart rollers 35 and 37 which bear against sides of the handle extension 9.

The carriage assembly 21 is mounted on a threaded rod 39 and a parallel guide rod 41 for reciprocal movement, along a longitudinal axis 43 defined by the threaded rod 39 and a guide rod 41. A reversible electric motor 45 rotates the threaded rod 39 in either direction to reciprocally drive the carriage assembly 21 along the longitudinal axis 43. Thus, by operation of a motor 45 the handle of the circuit breaker can be driven to the on (up) position or the reset (down) position.

Figure 8:
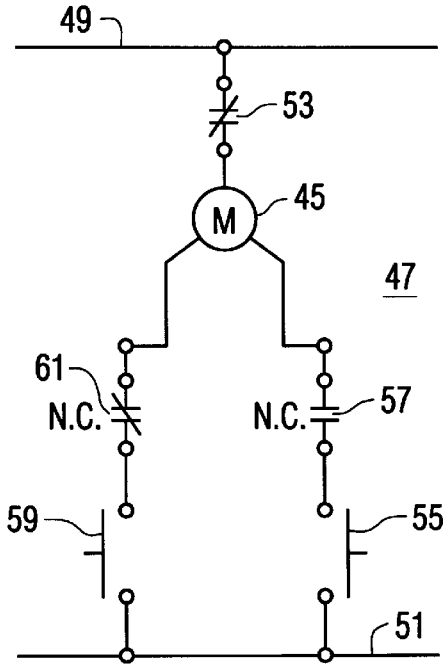
FIG. 8 is a schematic diagram of pertinent portions of the power circuit for the motor operator.

The power circuit 47 for the electric motor 45 is shown in FIG. 8. The motor 45 is energized by a pair of power leads 49 and 51. The motor 45 is connected through an interlock limit switch 53 to the power lead 49. The interlock limit switch 53 must be closed in order for the circuit breaker to be electrically operated. The motor may be operated to drive the carriage assembly to the off position by actuation of an off push button latching relay 55 which connects the motor 45 to the power lead 51 through an off limit switch 57. The off limit switch 57 is a normally closed (N.C.) switch which as shown, interrupts current flow to the motor when the switch handle reaches the off/reset position and opens the switch. The motor 45 is energized to rotate in the opposite direction by actuation of an on push button 59 which connects the motor to the power lead 51 through the on limit switch 61. The on limit switch 61 is also a normally closed (N.C.) switch which is opened when the switch handle reaches the on position to deenergize the motor 45.

Returning to FIG. 3, the off limit switch 57 and on limit switch 61 are mounted on brackets 63 adjacent the carriage assembly 21. An actuating plate 65 has curved ends which engage the actuating lever 67 and 69 of the switches 57 and 61 respectively as the carriage assembly reaches its limits of travel. Thus, when the carriage assembly 21 reaches the off/reset position near the bottom of the enclosure in FIG. 3, the actuation plate 65 engages the actuating lever 67 to actuate the off limit switch 57 and deenergize the motor 45. Similarly, when the carriage assembly reaches its upper limit of travel and has turned the circuit breaker on, the actuating plate 65 engages the actuating lever 69 to actuate the on limit switch 61 and turn off the motor 45.

When the circuit breaker trips, the handle is spring biased to the intermediate trip position. The ball nut 23 has very low friction so that the carriage assembly 21 is driven by the handle toward an intermediate position which is shown in FIG. 3. As can be seen from FIG. 3, with the handle and carriage in the intermediate position, both the off limit switch 57 and on limit switch 61 are unactuated thereby permitting either push button to be used to energize the motor 45. As explained, the handle must be moved to the reset position before the circuit breaker can be again turned on. However, it has been found that the motor 45 typically used is not powerful enough to reset the circuit breaker starting from the intermediate position. Therefore, it is recommended that the on push button 59 be actuated first to drive the carriage toward the on position so that then when the off push button is actuated the motor and carriage assembly can generate sufficient inertia to reset the circuit breaker. If the user ignores or is unaware of these instructions, and attempts to reset the circuit breaker from the tripped position, the motor will be deenergized when the off limit switch 57 is actuated; however, without reset, the spring in the circuit breaker will drive the handle back to the tripped position dragging the carriage assembly with it. This deactuates the off limit switch 57 as shown in FIG. 3. If the user repeatedly attempts to electrically reset the circuit breaker, the motor can overheat and be damaged. This is particularly likely in situations that employ latching relays in connection with the on and off switches. The latching relays will cause the motor to automatically recycle.

Figure 6A:
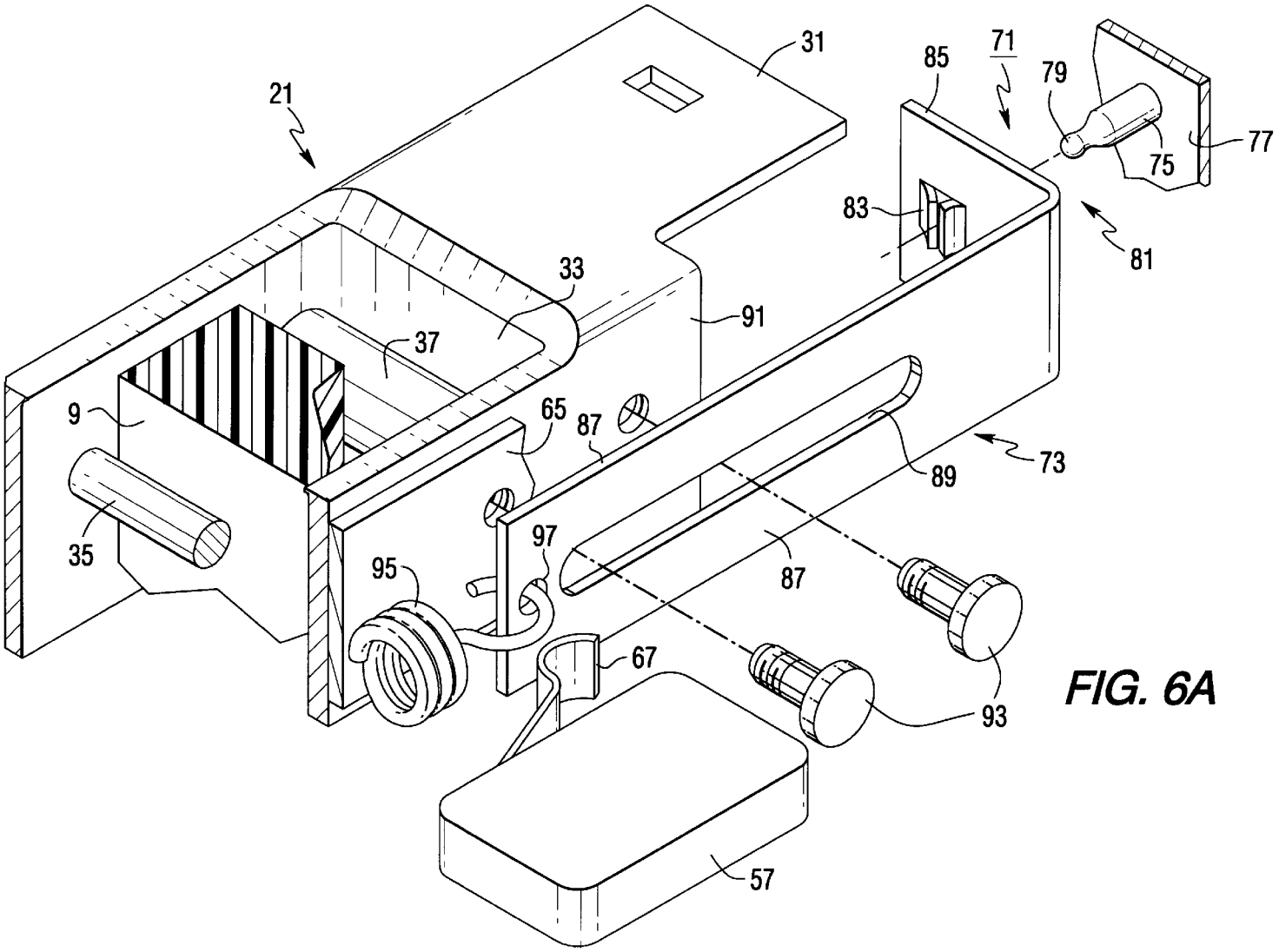
FIGS. 6A and B are isometric views of the override device in accordance with the invention and a portion of the carriage on which it is mounted respectively illustrating two embodiments of the invention.
Figure 6B:
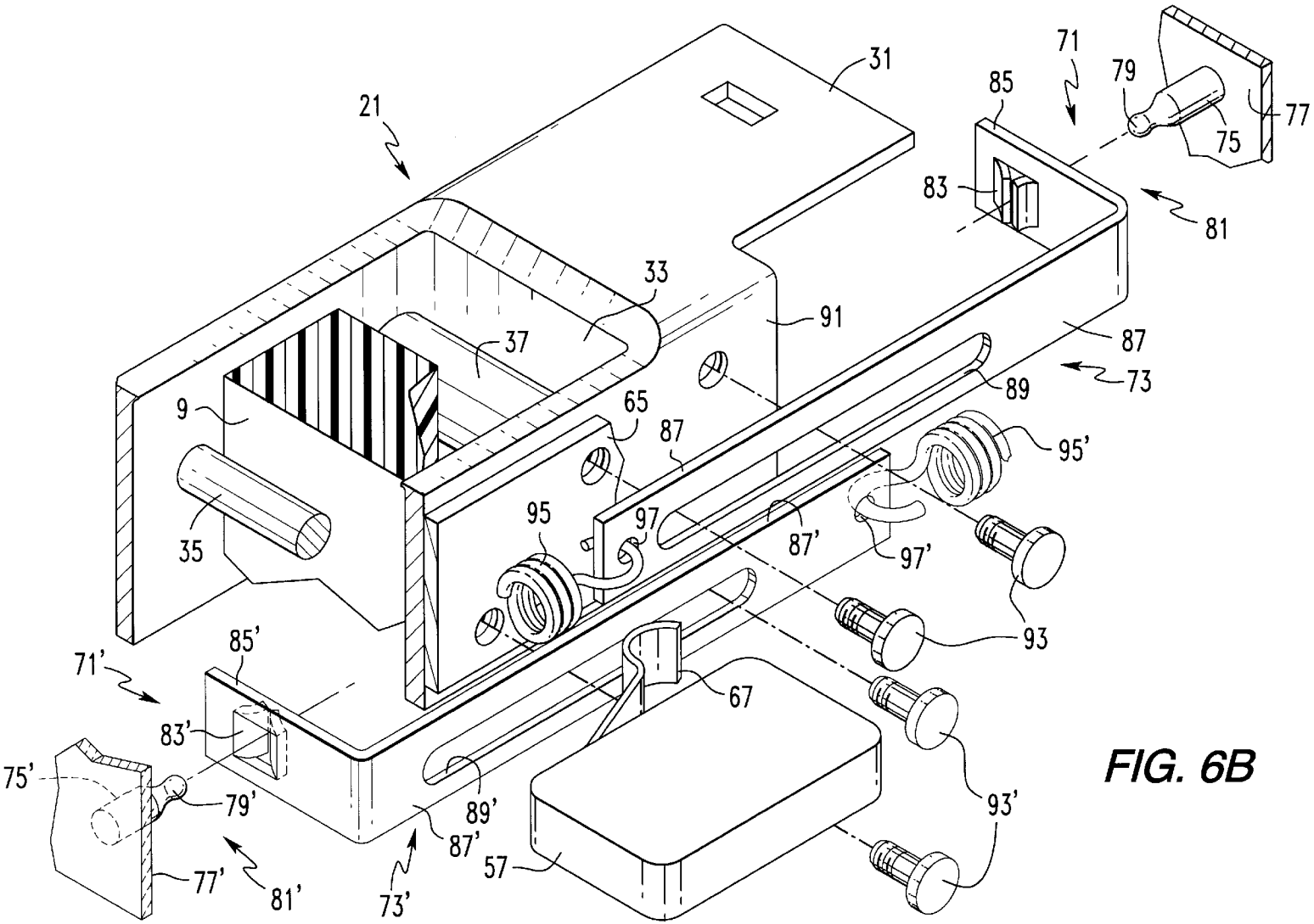

The invention prevents repeated unsuccessful attempts to reset the circuit breaker starting from the tripped position. As shown in FIGS. 4–6, an override device 71 is mounted on the carriage assembly 21 to maintain actuation of the off limit switch 57 when the handle 3, and therefore, the carriage rebound toward the trip position following an unsuccessful attempt to reset the circuit breaker. This override device 71 includes a first member 73 in the form of an L-shaped bracket and a second member 75 mounted on the bottom wall 77 of the enclosure 17. The second member 75 is in the form of a stud having an enlarged head 79 which forms the male part of a releasable fastener 81 which also includes a female part formed by a pair of tabs 83 punched out of the flange 85 on the L-shaped bracket 73. The main section 87 of the L-shaped bracket 73 has an elongated slot 89 extending longitudinally therein. The bracket 73 is slidably connected to a depending flange 91 on the plate 31 of the carriage assembly 21 by a pair of guides in the form of bolts 93. A helical tension spring 95 hooked in an aperture 97 in the end of the elongated section 87 and at the other end to a tab 99 on the flange 91 biases the L-shaped bracket 73 against the carriage assembly 21. When the carriage, and therefore, the handle are driven toward the reset (lower) position, the male part 75 of the releasable fastener 81 engages the female part 83 to releasably secure the L-shaped bracket 73 to the male part 75 as shown in FIG. 4. Then, if the circuit breaker does not reset and the carriage rebounds with the handle to the trip position as shown in FIG. 5, the L-shaped bracket 73 remains attached to the male part 75 and extends to the carriage assembly so that the off limit switch 57 remains actuated. As previously stated, with the normally closed off limit switch 57 actuated, the motor 45 cannot be energized to drive the carriage in the off direction. Only the on push button 61 is effective to drive the motor under these conditions as the on limit switch 61 remains unactuated. As can be seen from FIG. 5, the carriage assembly is in the same position as in FIG. 3, so that without the override device 71, the off limit switch would not be actuated permitting the handle to again be driven toward off/reset.

Figure 7A:
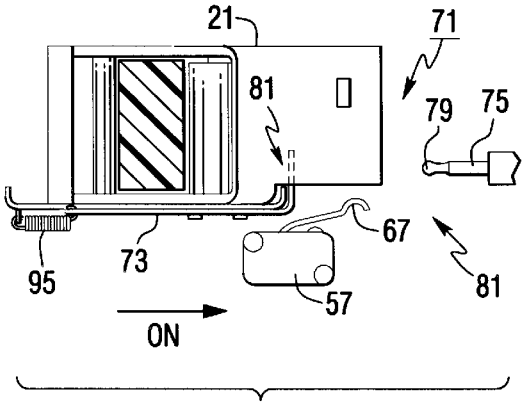
FIGS. 7*a–e* illustrates schematically the operation of the invention.
Figure 7B:
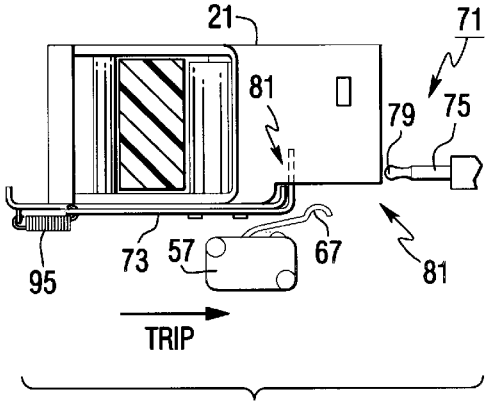
Figure 7C:
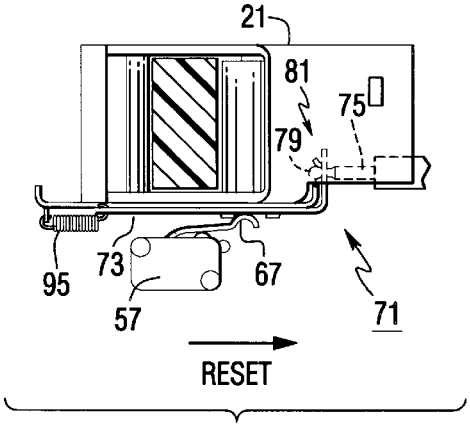
Figure 7D:
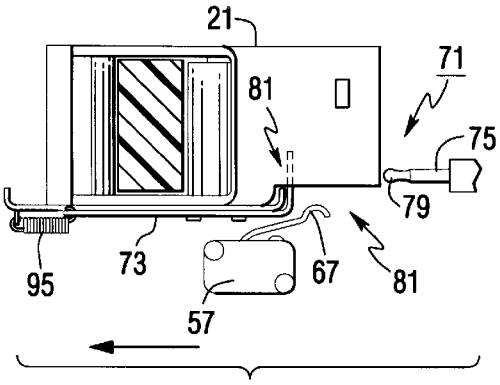
Figure 7E:
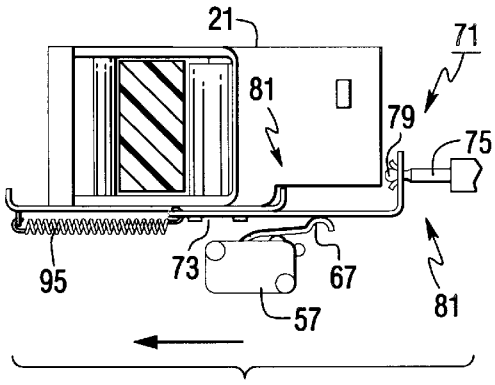

FIGS. 7*a* through 7*e* schematically illustrate operation of the motor operator with the invention of patent application Ser. No. 08/699,305. FIG. 7*a* shows the carriage assembly 21 in the on position in which the L-shaped bracket 73 is in a retracted position against the carriage assembly 21 and the off limit switch 57 is unactuated. Thus, the motor can be operated to drive the carriage, and therefore the handle, toward the off position. If the circuit breaker trips, the carriage is moved to the intermediate position shown in 7*b* in which the off limit switch 57 remains unactuated. As noted, users are advised to actuate the on push button 59 to move the handle to the on position before actuating the off push button so that enough inertia will be generated by the carriage assembly to reset the circuit breaker. However, with the circuit breaker tripped as shown in FIG. 7*b*, it is possible for the motor to be energized to drive the handle toward the off reset position. When the reset position is reached as indicated in FIG. 7*c*, the releasable fastener 81 will engage to releasably secure the bracket 73 to the male portion 75. If the circuit breaker does not reset, and the handle and carriage rebound to the trip position as shown in FIG. 7 the bracket remains secured to the male member 75 and therefore is extended from the carriage assembly to maintain actuation of limit switch 57. Thus, the operator will be unable to repeatedly drive the carriage assembly from the tripped position to the off reset position. Therefore, the on push button 61 must be actuated to drive the carriage toward the on position. When the bracket 73 is extended to the point where the bracket 73 reaches the end of the elongated slot 89 (see FIG. 6), the bracket will be pulled free of the male portion 75 and the spring 95 will retract the bracket against the flange 91 of the carriage assembly 21 as shown in FIG. 7*e*. Thus, while the invention permits the operator to make one attempt to reset the circuit breaker from the trip position, repeated unsuccessful attempts are prevented, and the user will eventually have to go through the on position in order to make additional attempts to reset the circuit breaker.

The present invention expands upon the improvement of patent application Ser. No. 08/699,305 by introducing a second override mechanism 71' shown in FIG. 6B which is a mirror image of the override mechanism 71 and operates in the opposite direction in combination with the on limit switch 61. The brackets 87 and 87' are sized to be less than half the height of the carriage assembly 21 so that one may freely move above the other in opposite directions. Override mechanism 71' operates the same as has been described for override mechanism 71, but in the opposite position in conjunction with limit switch 61 to prevent the motor operator from repeatedly driving the handle 9 toward the on position when the breaker has not successfully reset. In this way damage to the motor is prevented. While the bracket 87' has been illustrated as being spring biased by the elastic member 95' a further improvement to this invention is to affix the bracket 87' to the side 91 of the carriage assembly 21 by tightening down the screws 93' so that when the handle 9 is driven to the on position the male and female portions 79' and 83', respectively, of the carriage 21 captures the handle in full on position without permitting the handle to return to the trip position under the counterforce of the spring bias being applied to the handle. In this way, the off button can be pressed to enable the handle to gain its full momentum to reset the breaker without concern to the timing of when the on and off switches are depressed for this purpose. Thus, the improvement of this invention provides improved protection for the motor operator and makes it more convenient to reset the breaker from a remote location.

Figure 9:
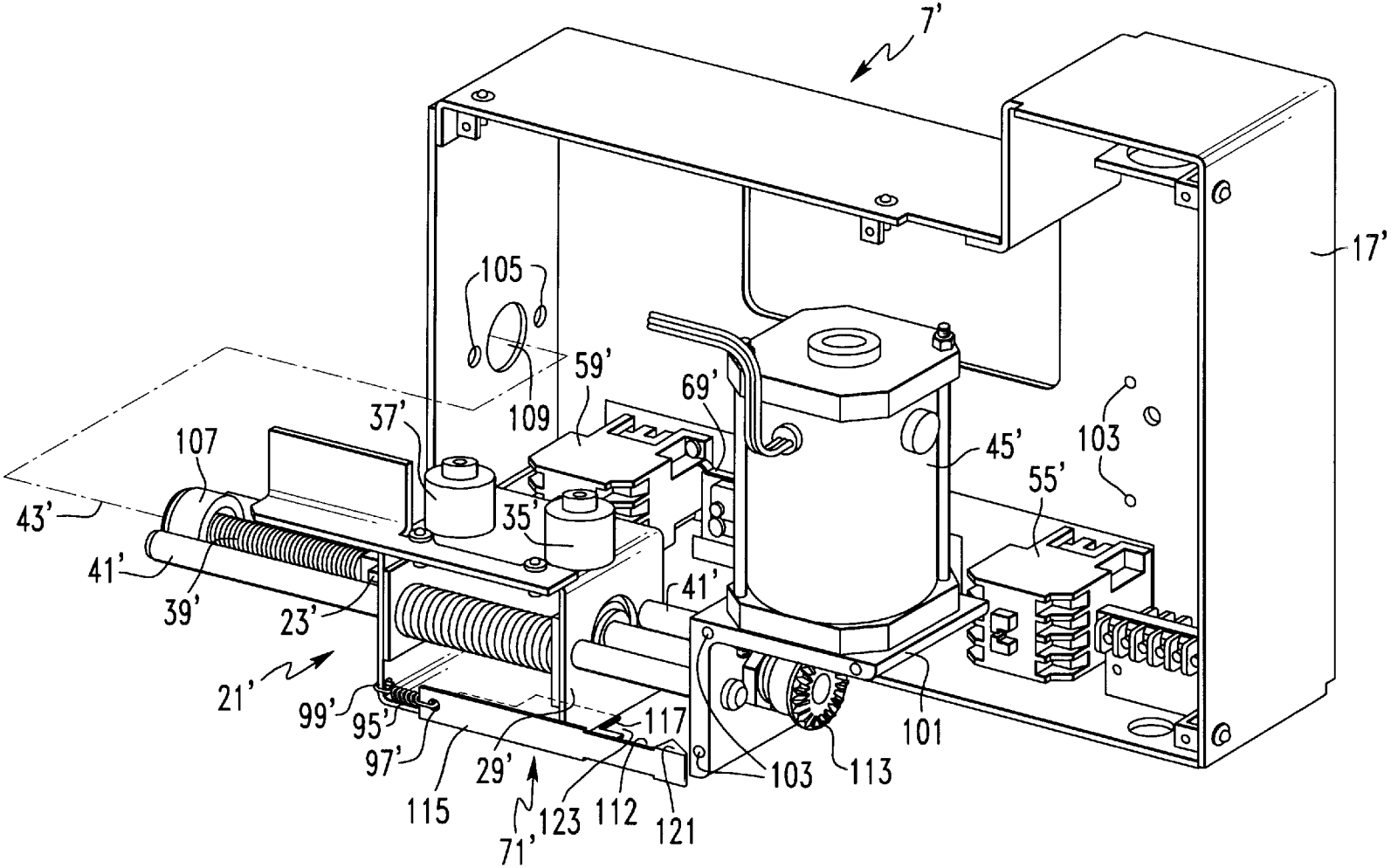
FIG. 9 is an exploded view of a third embodiment of the motor operator of this invention for maintaining the on limit switch in engagement, that uses a perpendicular motor drive.
Figure 10:
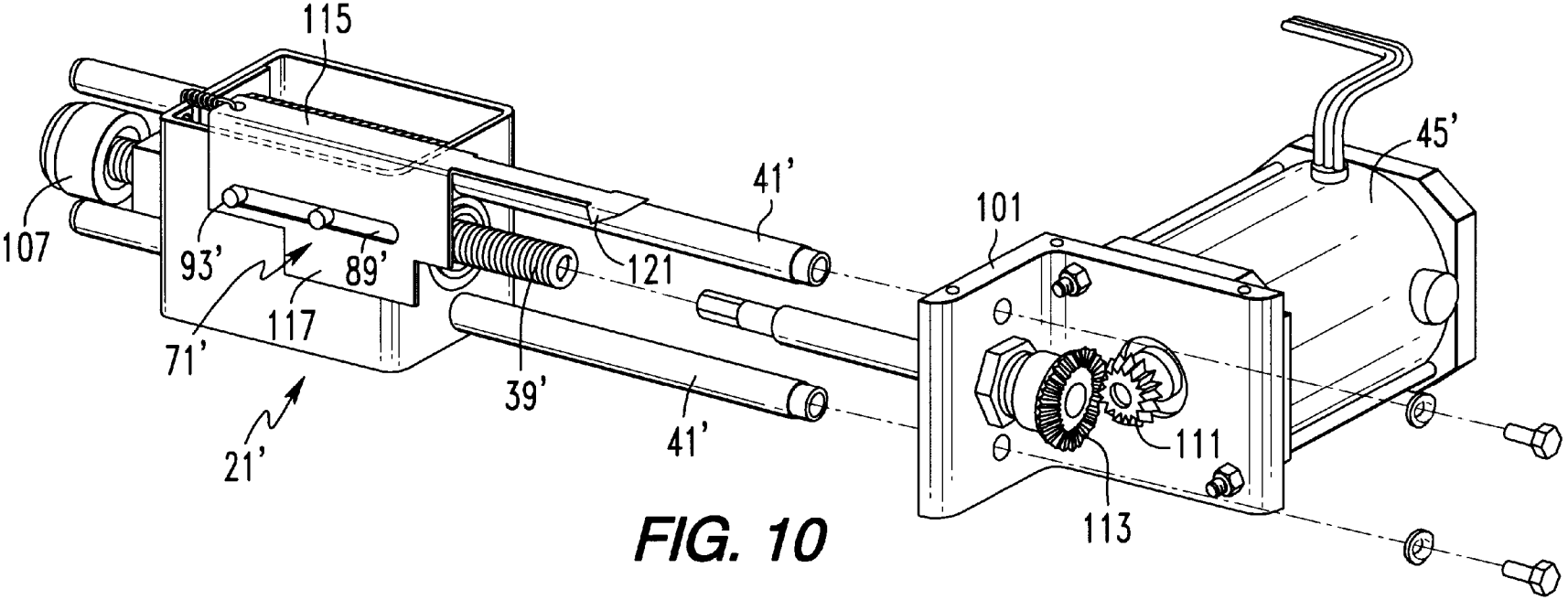
FIG. 10 is an isometric exploded view of the drive mechanism of the motor operator of FIG. 9.
Figure 11C:
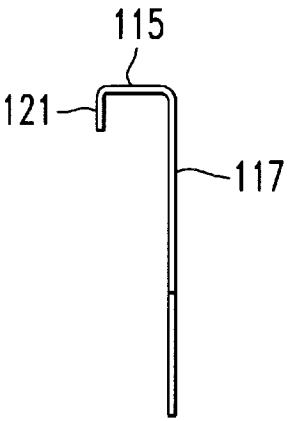
FIGS. 11A–C are respectively front, top and side views of the antibounce bracket of the embodiment of FIGS. 8 and 9.
Figure 11B:
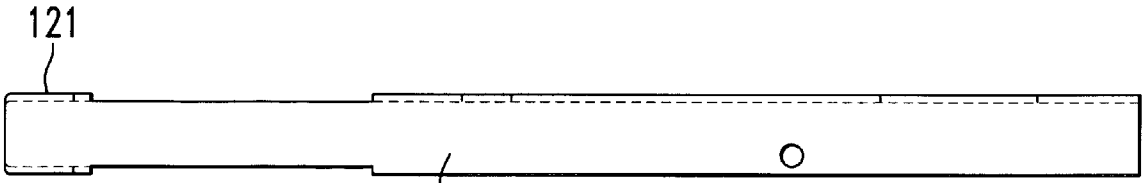
Figure 11A:
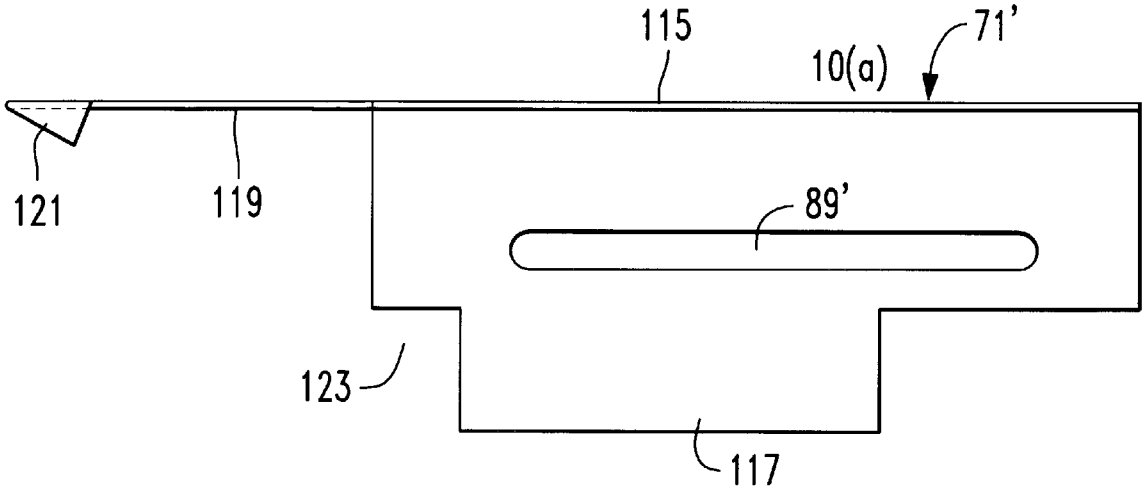

FIG. 9 shows a second embodiment of the motor operator previously illustrated in FIGS. 1 through 6. The embodiment shown in FIG. 9 illustrates a right angle drive system design in which components corresponding to those previously described are shown with the same reference numerals primed. The motor assembly 45' is held in place by a motor support bracket 101 which is attached to the motor operator housing 17' through the insertion of fasteners (such as screws) through the holes 103 into the back of the panel 17'. The threaded drive rod has its bearing 107 supported within recess 109 in the housing 17'. The guide rods 41' are appropriately fastened, such as with screws, through the apertures 105 in the side of the motor operator housing 17'. As can better be appreciated from FIG. 10, motor rotation is translated 90° to the drive screw 39' by the interaction of bevelled gears 111 and 113. A more detailed description of the right angle drive system design can be found in U.S. Pat. No. 5,196,658 issued Mar. 23, 1993 to assignee of this application. The circuit breaker handle fits within the rollers 35' and 37' in the same manner as previously described in regard to the operation of the moveable carriage 21.

The override mechanism 71' of this embodiment which retains the on limit switch actuator in the engaged condition to turn off the motor 45' is shown in FIGS. 9, 10 and 11A–C. The on limit and the on and off push buttons previously described are shown in FIG. 9, respectively, by reference characters 69', 59' and 45'.

The override plate 71' in this embodiment includes a flange section 115 and a flat main section 117 having an elongated slot 89' which is guided over studs 93'. The main section of the plate 117 is biased toward the side of the carriage 21 opposite the motor bracket 101 by a helical spring 95' which is supported on one side in an aperture at 97' and attached to a tab 99' on the carriage 21'. The flat main section 117 of the override device 71' includes an extended portion with a cutout section 119 which is supported by the extension of the flange 115 and a triangular tab 121 which extends from the end of that extension. The main flat section 117 also includes a separate notch 123 which will depress the on limit switch lever 69' when the carriage 21' is driven to the on position. In operation the override device 71' travels with the carriage 21' until the motor is driven to the full on position, at which point the extension of the main section 117, which is made of spring steel, at the triangular tab 121, rides over the motor bracket 101 and catches the bracket which retains the override device 71' as the handle carriage 21' moves in reverse to the trip position, under conditions where the breaker has not been reset. In this way, the limit switch 69 continues to be actuated and maintains the motor in the off state. The on switch 59' in many cases is a latched relay. Thus, the override device 71' prevents the motor from recycling as would have been the case with previous designs. The side of the tab 121 is slightly bevelled so that when the carriage 21' is driven under the force of the motor to the off position it pulls the override device free from its catch on the motor bracket 101. Thus, the override device 71' of this embodiment accomplishes the same objective of this invention described for the previous embodiments and can work equally as well with an in-line motor drive.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A motor operator for a circuit breaker having a handle moveable, within a housing, from an on position, through a trip position to an off position and a reset position, and wherein the handle is spring biased toward the trip position from the on position under trip conditions until the circuit breaker is reset, said motor operator comprising:

a carriage engaging said circuit breaker handle and mounted for reciprocal movement along a longitudinal axis for operating said handle between said on and said reset position;

an electric motor for effecting said reciprocal movement of said carriage when energized;

a power circuit for energizing said electric motor including an on limit switch which is actuated by said carriage with said handle in the on position to deenergize said electric motor when said circuit breaker handle is moved to the on position but which is normally unactuated when said handle and therefore said carriage rebound toward said trip position when the circuit breaker is not reset; and override means maintaining actuation of said on limit switch when said handle and therefore said carriage rebound toward said trip position when an attempt to reset said circuit breaker is unsuccessful.

2. The motor operator of claim 1 wherein the override means is affixed to the carriage and operable to engage a fixture fixably attached to said housing.

3. The motor operator of claim 2 wherein the override means is affixedly attached to the carriage and when engaged with the fixture prevents the handle from moving to the reset position.

4. The motor operator of claim 2 wherein the override means includes a resilient member adapted to ride over and catch the fixture.

5. The motor operator of claim 1 wherein the override means is slidably mounted on the carriage and moveable parallel to the axis of movement of the carriage.

6. The motor operator of claim 5 wherein said override means is biased toward the carriage.

7. The motor operator of claim 6 wherein said override means includes a bracket on said carriage comprising a slot in one of said carriage and said bracket extending parallel to the axis of movement, and guide means on the other of said carriage and said bracket engaging said slot.

8. The motor operator of claim 7 wherein said biasing means comprises a spring connected to said bracket and said carriage biasing said bracket to a retracted position to said carriage.

9. The motor operator of claim 1 wherein the power circuit includes an off limit switch which is actuated by the carriage when the handle is in the off position to deenergize said electric motor when said circuit breaker handle is moved to the reset position but which is normally unactuated when said handle and therefore said carriage rebound toward said trip position when the circuit breaker is not reset; and wherein the override means maintains actuation of the off limit switch when said handle and therefore said carriage rebound towards the trip position when attempt to reset said circuit breaker is unsuccessful.

* * * * *